US010069238B2

(12) United States Patent
Mayer-Rosa et al.

(10) Patent No.: US 10,069,238 B2
(45) **Date of Patent: *Sep. 4, 2018**

(54) ELECTRIC CABLE FOR USE IN A WELDING DEVICE

(71) Applicant: Balluff GmbH, Neuhausen a.d.F. (DE)

(72) Inventors: Michael Mayer-Rosa, Neuhausen (DE); Thomas Bayer, Neuhausen a.d.F. (DE); Andreas Kammerer, Winnenden (DE)

(73) Assignee: Balluff GmbH, Neuhausen a.d.F. (DE)

( * ) Notice: Subject to any disclaimer, the term of this patent is extended or adjusted under 35 U.S.C. 154(b) by 316 days.

This patent is subject to a terminal disclaimer.

(21) Appl. No.: 15/073,773

(22) Filed: Mar. 18, 2016

(65) Prior Publication Data

US 2016/0322740 A1 Nov. 3, 2016

(30) Foreign Application Priority Data

Apr. 29, 2015 (DE) ..... 20 2015 102 166 U

(51) Int. Cl.
*H01R 13/533* (2006.01)
*H01B 3/46* (2006.01)
(Continued)

(52) U.S. Cl.
CPC ..... *H01R 13/533* (2013.01); *H01B 3/30* (2013.01); *H01B 3/46* (2013.01); *H01B 7/295* (2013.01); *H01R 9/11* (2013.01); *H01R 13/7175* (2013.01)

(58) Field of Classification Search
CPC ... H01B 3/08; H01B 3/30; H01B 3/02; H01B 7/29; H01B 7/292; H01B 7/295; H01R 13/5845; H01R 13/7175; H01R 9/11
See application file for complete search history.

(56) References Cited

U.S. PATENT DOCUMENTS 3,823,255 A * 7/1974 La Gase ..... H01B 7/295 174/113 R
4,150,249 A * 4/1979 Pedersen ..... H01B 7/295 174/103

(Continued)

OTHER PUBLICATIONS

IEC 60332-2-2, Tests on electric and optical fibre cables under fire condition—Part 2-2: Test for vertical flame propagation for a single small insulated wire or cable—Procedure for diffusion flame, First Edition, Jul. 2004, total of 36 pages.
DIN ISO 7619-1, Rubber, vulcanized or thermoplastic—Determination of indentation hardness—Part 1: Durometer method (Shore hardness) (ISO 7619-1:2010), Feb. 2012, total of 17 pages.
DIN ISO 7619-2, Rubber, vulcanized or thermoplastic—Determination of indentation hardness—Part 2: IRHD pocket meter method (ISO 7619-2:2010), Feb. 2012, total of 10 pages.

(Continued)

*Primary Examiner* — Hoa C Nguyen
*Assistant Examiner* — Amol Patel
(74) *Attorney, Agent, or Firm* — Collard & Roe, P.C.

(57) ABSTRACT

An electric cable includes at least one current line having first and second ends, including several wires, a first plug connector and at least one second plug connector arranged on the first and second ends, respectively. At least one plug connector includes a material having A) 98.0% to 99.8% by weight of a polymer selected from the group consisting of polyurethane (PU), styrene-butadiene block copolymers (SBS), perfluorocarbons and mixtures thereof, and B) 0.2% to 2.0% by weight additives. The total of components A and B results in 100% by weight. A first connection nut and at least one second connection nut are arranged on the first and second plug connectors, respectively. At least one light source is arranged in a first plug connector and/or in a second plug connector and is configured in order to be supplied with electrical energy by at least one wire of the current line.

16 Claims, 2 Drawing Sheets

(51) Int. Cl.

| | |
|---|---|
| ***H01B 7/295*** | (2006.01) |
| ***H01R 13/717*** | (2006.01) |
| ***H01R 9/11*** | (2006.01) |
| ***H01B 3/30*** | (2006.01) |

(56) References Cited

U.S. PATENT DOCUMENTS

| | | | | |
|---|---|---|---|---|
| 4,547,626 | A * | 10/1985 | Pedersen | G02B 6/4416 174/107 |
| 4,659,871 | A | 4/1987 | Smith et al. | |
| 6,577,243 | B1 * | 6/2003 | Dannenmann | H01R 13/641 324/66 |
| 7,049,937 | B1 * | 5/2006 | Zweig | H01R 13/641 324/66 |
| 7,211,766 | B2 * | 5/2007 | Rehrig | B23K 9/323 174/15.6 |
| 7,247,797 | B2 * | 7/2007 | Buthe | H01B 7/295 174/110 R |
| 7,378,595 | B2 * | 5/2008 | Brambilla | H01B 3/04 174/113 R |
| 7,511,245 | B2 * | 3/2009 | Hsu | B23K 9/201 219/98 |
| 8,937,251 | B2 | 1/2015 | Mayer-Rosa et al. | |
| 8,937,252 | B2 | 1/2015 | Mayer-Rosa et al. | |
| 2007/0087637 | A1 | 4/2007 | Zart et al. | |
| 2009/0056974 | A1 | 3/2009 | Groegl et al. | |
| 2011/0120745 | A1 * | 5/2011 | Booth | G01V 1/201 174/113 R |
| 2013/0206463 | A1 * | 8/2013 | Boday | C07F 9/4012 174/258 |

OTHER PUBLICATIONS

English translation of DIN EN 13602, Copper and copper alloys—Drawn, round copper wire for the manufacture of electrical conductors, Sep. 2013, total of 24 pages.

CEI IEC 60529, Degrees of protection provided by enclosures (IP Code), Edition 2.1, Feb. 2001, total of 102 pages, with Correction 1 dated Jan. 2003 and Correction 2 dated Oct. 2007.

ISO 868, Plastics and ebonite—Determination of indentation hardness by means of a durometer (Shore hardness), Mar. 1, 2003, total of 12 pages.

English translation of DIN 53504, Testing of rubber—Determination of tensile strength at break, tensile stress at yield, elongation at break and stress values in a tensile test, Oct. 2009, total of 18 pages.

DIN ISO 34-1, Rubber, vulcanized or thermoplastic—Determination of tear strength, Part 1: Trouser, angle and crescent test pieces, Jul. 2004, total of 14 pages. (and also DIN ISO 34-1, Jul. 2005, Correction to DIN ISO 34-1:Jul. 2004, 2 pages).

English translation of DIN ISO 4649, Rubber, vulcanized or thermoplastic—Determination of abrasion resistance using a rotating cylindrical drum device, Nov. 2006, total of 20 pages.

ISO 7619-1, Rubber, vulcanized or thermoplastic—Determination of indentation hardness—Part 1: Durometer method (Shore hardness), Second edition, Oct. 1, 2010, total of 20 pages.

English translation of DIN EN ISO 179-1, Plastics—Determination of Charpy impact properties—Part 1: Non-instrumented impact test, Nov. 2010, total of 29 pages.

* cited by examiner

ELECTRIC CABLE FOR USE IN A WELDING DEVICE

CROSS REFERENCE TO RELATED APPLICATIONS

Applicant claims priority under 35 U.S.C. § 119 of German Application No. 20 2015 102 166.6 filed Apr. 29, 2015, the disclosure of which is incorporated by reference.

BACKGROUND OF THE INVENTION

Field of the Invention

The present invention relates to an electric cable. Furthermore, the invention relates to the use of the electric cable as a control line for a welding device, in particular in the automotive industry.

Prior Art

Welding devices, in particular welding robots for automated industrial applications, require for their control electric cables which can withstand stresses. It is required that such electric cables are flame-retardant according to different standards such as IEC 60332-2, VDE 0482-265-2-2 and EN 50265-2-2. Furthermore, they must be able to be withstand contact with welding beads, i.e. metal which melts and sprays during the welding, over a long period of time.

For the functional control of electric cables, control lights, such as, for example LEDs, can be provided on these. However, this control possibility has not existed for electric cables for welding devices until now. Even electric cables known today without control lights, which are used in welding devices must be replaced regularly, as an exposure of cable wires occurs very often due to the rough conditions during welding. Conventional electric cables with control lights could not withstand these conditions even in the short term. It is therefore the object of the present invention to provide an electric cable which has a particularly high resistance to welding conditions and which can be used as a control line for a welding device, and which has at least one control light.

SUMMARY OF THE INVENTION

This object is solved by the electric cable according to the invention. This comprises at least one current line having a first end and a second end, comprising several wires, a first plug connector which is arranged on the first end of the current line and at least one second plug connector which is arranged on the second end of the current line. At least one plug connector consists of a material which has, as component A, 98.0% by weight to 99.8% by weight of a polymer which is selected from the group consisting of polyurethane (PU), styrene-butadiene block copolymers (SBS), perfluorocarbons and mixtures thereof, and which has, as component B, 0.2% by weight to 2.0% by weight additives. The total of components A and B results in 100% by weight. The electric cable furthermore has a first connection nut, which is arranged on the first plug connector and it has at least one second connection nut which is arranged on a second plug connector. At least one light source is arranged in a first plug connector and/or in a second plug connector which consists of the material with components A and B. Each light source is configured in order to be supplied with electrical energy by means of at least one wire of the current line.

The arrangement according to the invention of the light source in a plug connector protects this from the conditions of a welding insert. The material of the plug connector thereby enables, on the one hand, an extraordinarily high resistance of the electric cable to the conditions of the welding insert. Therefore, it is in particular suitable for use as a control line for a welding device. On the other hand, this material, however, is also sufficiently translucent in order to enable a light emission of the light source through the plug connector.

The additives B were added to polymer A preferably as a master batch which contains no flame retardants. An opaquing effect of the flame retardant is hereby prevented. A sufficient flame resistance of the plug connector in order to withstand the conditions of a welding insert is already ensured by the inherent material properties of polymer A.

The material of the plug connector is preferably not only translucent, but transparent. This enables a particularly good transmission of the light emitted by the light source through the plug connector.

An LED is preferred as a light source, as this has a high heat tolerance and emits only little heat itself. This is important as the material of the plug connector prevents the discharging of the heat.

The current line comprises at least two wires and preferably four wires. Therefore, it can be connected as a pole-rectified cable in which the magnetic fields of the four wires are partially compensated for. The wires each consist in particular of tin-plated copper. They can, in addition to a function as control wires, supply the at least one light source with electrical energy.

Each wire preferably has a wire insulation. All wire insulations are surrounded by a mutual coating. The wire insulations and the coating each comprise a material which is selected independently of each other, from the group consisting of silicones, perfluorocarbons, cross-linked polyolefins, mica, glass fibres, ceramic fibres and mixtures thereof. The material of the wire insulations and the coating is particularly preferably selected independently of each other, from the group consisting of silicones, perfluorocarbons and mixtures thereof. The wire insulations and the coating preferably consist of the same material. This enables a uniform behaviour of the wire insulations and the coating in the case of thermal stress. The silicones are in particular fluorosilicones and/or the copolymers thereof. The cross-linked polyolefins are in particular cross-linked polyethylenes.

Optionally, an electrical shield can be arranged between the wire insulations and the coating. This preferably consists of metal fibres, particular preferably of nickel fibres.

In order to ensure a high welding bead resistance of the coating, this preferably contains a flame retardant. A halogen-free flame retardant is particularly preferred in this case, which results in a particularly high resistance of the coating. Furthermore, the coating can optionally be impregnated with a silicone.

The connection nuts each preferably comprise a perfluorocarbon.

Perfluorocarbons are understood according to the invention in particular as perfluoroalkanes, perfluorocoalkylenes, perfluoroalkoxypolymers and copolymers of methacrylates and perfluoroalkyl acrylates. Polytetrafluoroethylene (PTFE), perfluoroethylenepropylene (FEP) and mixtures thereof are preferred.

The plug connectors preferably comprise a polyurethane which is based on a polyester, a polyether or a polyester ether as a polyol. Among these, a polyether is particularly preferred. Furthermore, it is preferred that the plug connectors each consist of a material that has a hardness of at least Shore 50D according to the standards DIN 53505 and ISO 868. The tensile strength of the material preferably amounts to at least 45 MPa according to DIN 53504. Its elongation at break preferably amounts to at least 425% according to DIN 53504. Its tear resistance preferably amounts to at least 140 N/mm according to DIN ISO 34-1 Bb. Its abrasion preferably amounts to a maximum of 35 $mm^3$ according to DIN ISO 4649-A.

BRIEF DESCRIPTION OF THE DRAWINGS

Exemplary embodiments of the invention are illustrated in the drawings and are explained in more detail in the subsequent description.

EXEMPLARY EMBODIMENTS OF THE INVENTION

Figure 1:
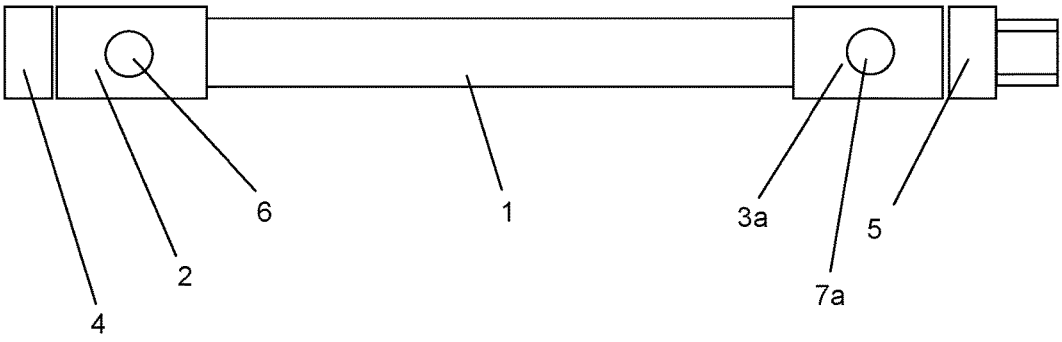
FIG. 1 shows a side view of an electric cable according to one embodiment of the invention.
Figure 2:
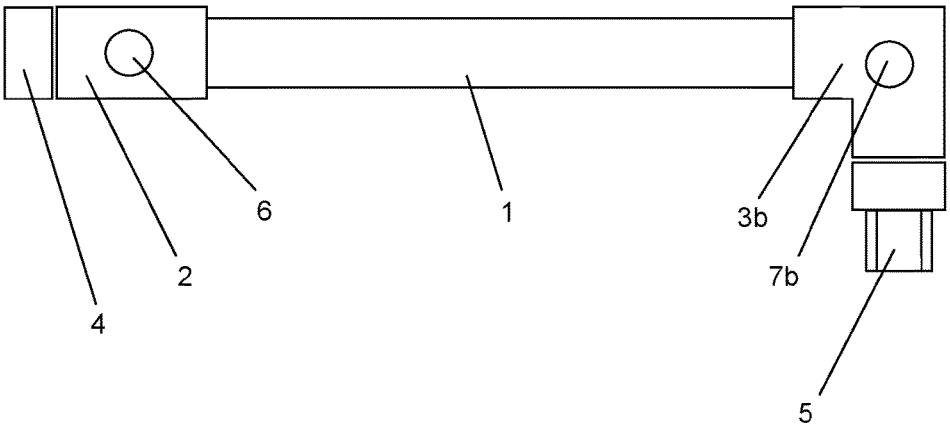
FIG. 2 shows a side view of an electric cable according to another embodiment of the invention.
Figure 3:
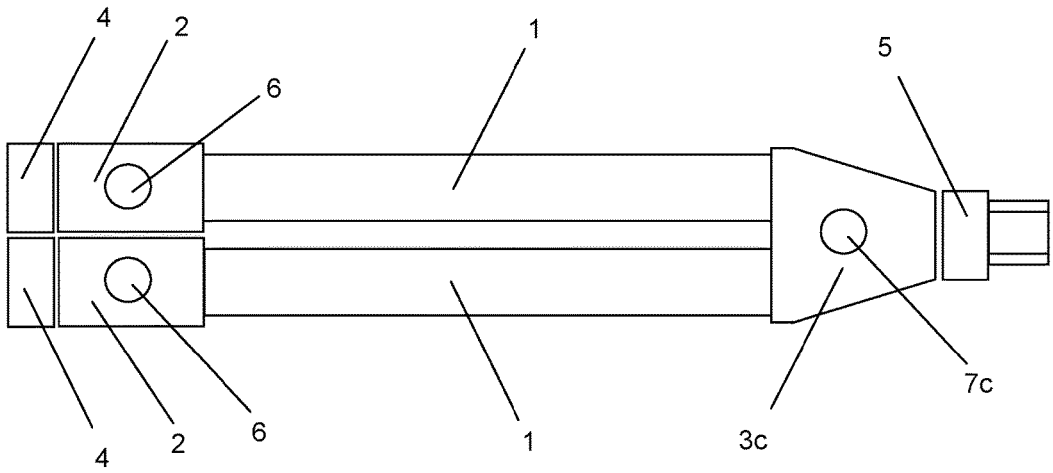
FIG. 3 shows a side view of an electric cable according to yet another embodiment of the invention.
Figure 4:
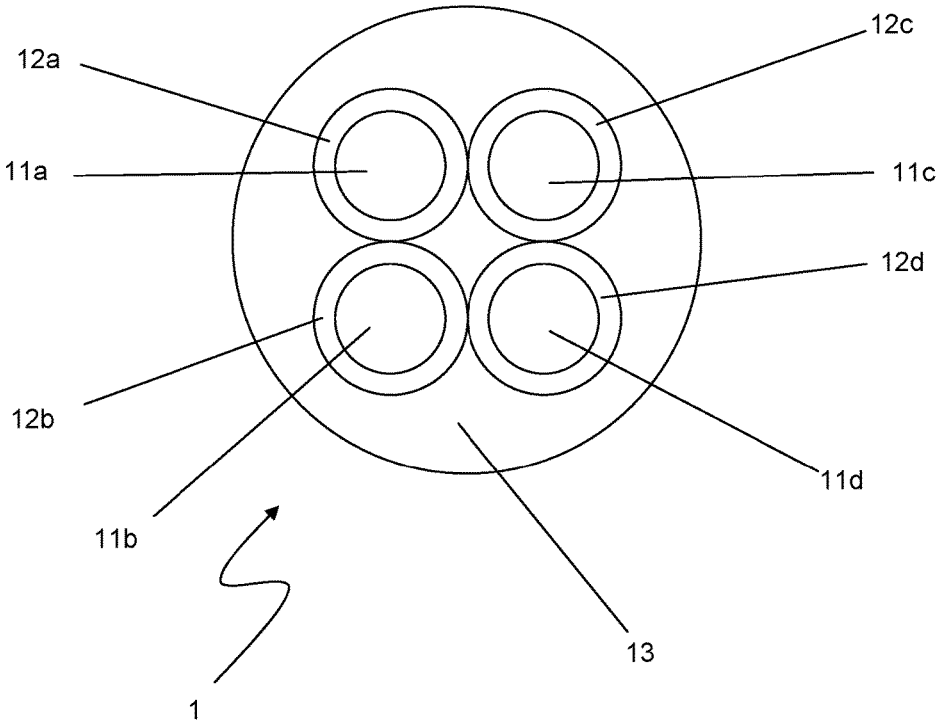
FIG. 4 shows a longitudinal cut through the current line of an electric cable according to one embodiment of the invention.

The resistance of cables to welding conditions was investigated in comparative examples (VB1 to VB7) and examples according to the invention (B1 and B2) of electric cables. The structure of such an electric cable is shown in three embodiments in FIGS. 1, 2 and 3. FIG. 4 shows a longitudinal cut through the current line 1 of this electric cable. The current line 1 comprises four wires 11*a*, 11*b*, 11*c*, 11*d*. Each wire, 11*a*, 11*b*, 11*c*, 11*d* has a wire insulation 12*a*, 12*b*, 12*c*, 12*d*. All wire insulations 12*a*, 12*b*, 12*c*, 12*d* are surrounded by a mutual coating 13. A first plug connector 2 is arranged on the first end of the current line 1. A second plug connector 3*a*, 3*b*, 3*c* is arranged on the second end of the current line. The second plug connector can be embodied as a linear plug connector 3*a*, as an angled plug connector 3*b* or as a Y-plug connector 3*c*. The plug connectors 2, 3*a*, 3*b*, 3*c* are each crimped onto the current line 1. A first connection nut 4 is arranged on the first plug connector 2. A second connection nut 5 is arranged on the second plug connector 3*a*, 3*b*, 3*c*. An LED is arranged as a light source 6, 7*a*, 7*b*, 7*c* in each plug connector. This is moulded into the material of the plug connector and is supplied with electrical energy by means of the wires 11*a*, 11*b*, 11*c*, 11*d*.

The wires 11*a*, 11*b*, 11*c*, 11*d* consisted in all examples of tin-plated copper and each had a cross-sectional area of 0.34 $mm^2$. The materials M12 of the wire insulations 12*a*, 12*b*, 12*c*, 12*d*, the materials M13 of the coatings 13, the materials M2/3 of the plug connectors 2, 3*a*, 3*b*, 3*c* and the materials M4/5 of the connection nuts 4, 5 are listed in Tables 1 and 2:

TABLE 1

| # | M12 | M13 | M2/3 | M4/5 | resistant |
|---|---|---|---|---|---|
| VB1 | PVC | PVC | 99% PU + 1% master batch | PTFE | no |
| VB2 | PVC | TPE-E | 99% PU + 1% master batch | PTFE | no |
| VB3 | PP | PU | 99% PU + 1% master batch | PTFE | no |
| VB4 | PTFE | FEP | PVC | PTFE | no |
| VB5 | silicone | silicone | PVC | PTFE | no |
| VB6 | PTFE | FEP | 99% PU + 1% master batch | steel | no |
| VB7 | silicone | silicone | 99% PU + 1% master batch | steel | no |
| VB8 | PP | glass | 99% PU + 1% master batch | steel | no |

TABLE 2

| # | M12 | M13 | M2/3 | M4/5 | resistant |
|---|---|---|---|---|---|
| B1 | PTFE | FEP | 99% PU + 1% master batch | PTFE | yes |
| B2 | silicone | silicone | 99% PU + 1% master batch | PTFE | yes |

Here, PVC stands for polyvinyl chloride, PP for polypropylene, PTFE for polytetrafluoroethylene, PU for polyurethane, FEP for perfluoroethylenepropylene and TPE-E for a thermoplastic polyester elastomer.

PVC Y17 (Shore hardness 90-95A) was used as a PVC for the wire insulation. PVC YM3 (Shore hardness AB0-B5) was used as a PVC for the coating and for the plug connectors. PP9Y (Shore hardness 54D) was used as a polypropylene. TPU 11YH1 (Shore hardness 54D) was used as a PU for the coating. Transparent Elastollan 1154D (Shore hardness 53D, tensile strength 50 MPa, elongation at break 450%, tear resistance 150 N/mm, abrasion 30 $mm^3$) of the company BASF, Ludwigshafen, Germany was used as a PU for the plug connectors 2, 3*a*, 3*b*, 3*c*. Teflon® of the company E.I du Pont de Nemours, Wilmington, USA was used as a PTFE and Teflon® FEP as an FEP. A flame retardant-free coloured granulate was used as a master batch. The percent specifications each refer to 100 percent by weight of the total material of the polyurethane and master batch. In the examples according to the invention B1 and B2, cables of the company Berger Spezialkabel, Henstedt-Ulzburg, Germany were used as a current conductor 1.

All investigated cables were used as a control line in an intrinsically known welding device in 62,200 consecutive welding cycles. Only the electric cables according to the invention of examples B1 and B2 withstood these experimental conditions without at least one of the wires thereby being exposed. Consequently, these have a particularly high resistance to welding conditions.

What is claimed is:

1. An electric cable, comprising:

at least one current line having a first end and a second end, comprising several wires, a first plug connector which is arranged on the first end of the current line, and at least one second plug connector which is arranged on the second end of the current line, wherein at least one plug connector comprises a material having A) 98.0% by weight to 99.8% by weight of a polymer which is selected from the group consisting of polyurethanes, styrene-butadiene block copolymers, perfluorocarbons and mixtures thereof, and B) 0.2% by weight to 2.0% by weight additives, wherein the total of components A and B results in 100% by weight, a first connection nut which is arranged on the first plug connector, and at least one second connection nut which is arranged on a second plug connector, and at least one light source which is arranged in the first plug connector or at least one light source which is arranged in the second plug connector, wherein the at least one light source is configured in order to be supplied with electrical energy by means of at least one wire of the current line.

2. The electric cable according to claim 1, wherein the additives were added to polymer A as a master batch which contains no flame retardants.

3. The electric cable according to claim 1, wherein the material of the plug connector is transparent.

4. The electric cable according to claim 1, wherein the at least one light source is an LED.

5. The electric cable according to claim 1, wherein each wire has a wire insulation and all wire insulations are surrounded by a mutual coating, and wherein the wire insulations and the coating each comprise a material which is selected independently of the other, from the group consisting of silicones, perfluorocarbons, cross-linked polyolefins, mica, glass fibres, ceramic fibres and mixtures thereof.

6. The electric cable according to claim 5, wherein the wire insulations and the coating comprise the same material.

7. The electric cable according to claim 5, wherein the coating contains a flame retardant.

8. The electric cable according to claim 5, wherein the silicones are fluorosilicones and/or the copolymers thereof.

9. The electric cable according to claim 1, wherein connection nuts each comprise a perfluorocarbon.

10. The electric cable according to claim 1, wherein the perfluorocarbon is selected from the group consisting of polytetrafluoroethylene, perfluoroethylene propylene and mixtures thereof.

11. The electric cable according to claim 1, wherein the polyurethane is based on a polyester, a polyether or a polyester ether.

12. The electric cable according to claim 1, wherein the plug connectors each comprise a material that has a hardness of at least Shore 50D.

13. The electric cable according to claim 1, wherein the current line comprises four wires.

14. The electric cable according to claim 1, wherein the wires each comprise tin-plated copper.

15. A control line for a welding device comprising the electric cable according to claim 1.

16. The electric cable according to claim 1, wherein the at least one light source comprises a first light source arranged in the first plug connector and a second light source arranged in the second plug connector.

* * * * *